US006108860A

United States Patent [19]

Crouser et al.

[11] Patent Number: 6,108,860

[45] **Date of Patent: *Aug. 29, 2000**

[54] COMPACT CARPET AND UPHOLSTERY EXTRACTOR

[75] Inventors: Darwin S. Crouser; Douglas C. Barker; Edgar A. Maurer, all of Canton, Ohio

[73] Assignee: The Hoover Company, North Canton, Ohio

[ * ] Notice: This patent is subject to a terminal disclaimer.

[21] Appl. No.: 09/057,229

[22] Filed: Apr. 8, 1998

Related U.S. Application Data

[62] Division of application No. 08/642,788, May 3, 1996, Pat. No. 5,870,798.

[51] Int. Cl.[7] ..... A47L 7/00

[52] U.S. Cl. ..... 15/321; 15/322; 15/352; 15/353; 15/387

[58] Field of Search ..... 15/320, 321, 322, 15/352, 353, 387; 222/572

[56] References Cited

U.S. PATENT DOCUMENTS

| | | |
|---|---|---|
| 3,858,767 | 1/1975 | Borin . |
| 4,041,569 | 8/1977 | Petersen . |
| 5,815,881 | 10/1998 | Sjogreen . |
| 5,870,798 | 2/1999 | Crouser et al. . |

FOREIGN PATENT DOCUMENTS

94/27486 12/1994 WIPO .

*Primary Examiner*—William H. Beisner
*Attorney, Agent, or Firm*—A. Burgess Lowe; Bruce P. Watson

[57] ABSTRACT

A portable compact extractor having permanent solution and recovery tanks integrally formed in a single main tank portion, with a removable power head attached to the top of the main tank. A fill port passes through the powerhead into the cleaning solution tank and a pour spout is formed in the recovery tank. With this construction, the cleaning solution tank may be filled with water and, if desired, detergent, by pouring the water and detergent into the fill port in the power head, and the recovery tank may be emptied as desired simply by tipping the unit and pouring the contents of the recovery tank out the pour spout and down the drain, without ever having to remove any tanks, bottles or the power head from the unit, or disconnect and reconnect any tubes. A carry handle is located on the powerhead to facilitate transportation of the unit, removal of the power head from the main tank for cleaning the tanks when desired, and to facilitate pouring the contents of the recovery tank out of the pour spout. A blower located in the powerhead provides suction in the recovery tank for suctioning liquid from a surface into the recovery tank and for driving a pneumatically driven pump for providing a source of pressurized cleaning solution for application to a surface to be cleaned.

15 Claims, 13 Drawing Sheets

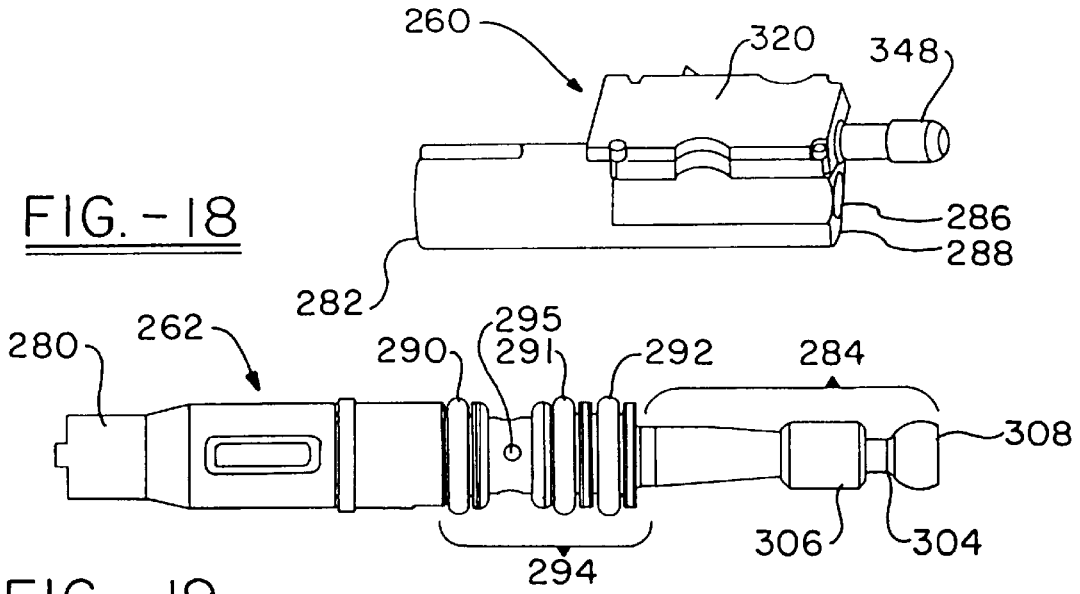
FIG.-18
FIG.-19
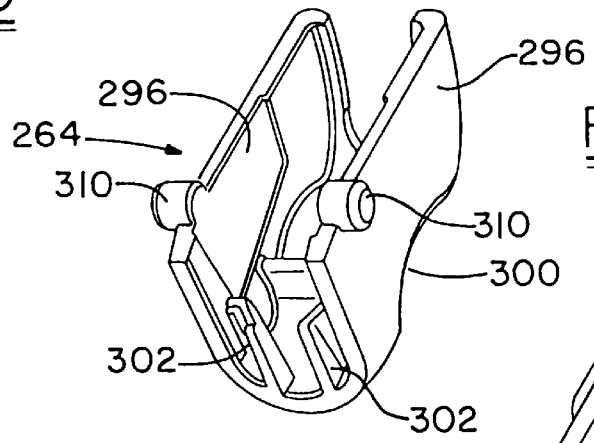
FIG.-20
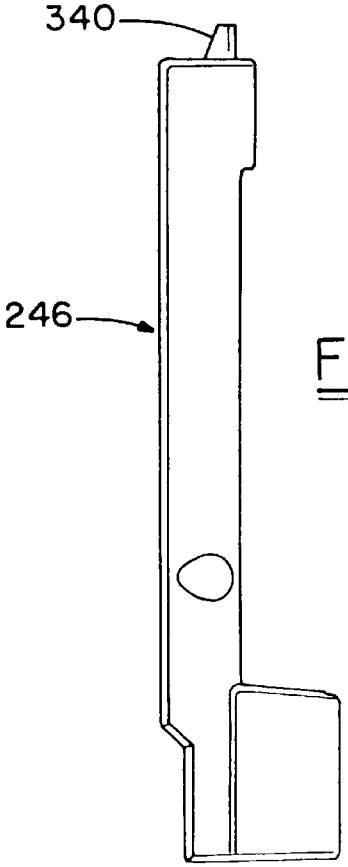
FIG.-21
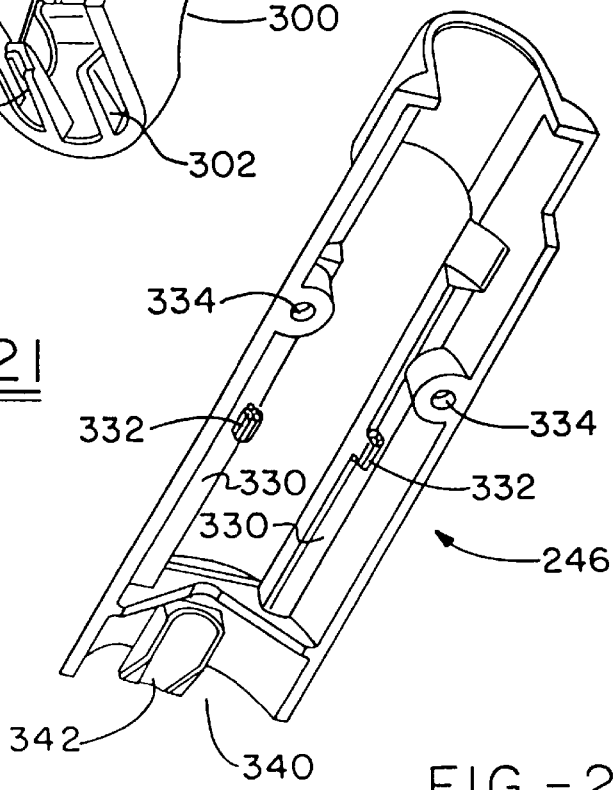
FIG.-22

COMPACT CARPET AND UPHOLSTERY EXTRACTOR

RELATED APPLICATIONS

This application is a divisional of U.S. patent application Ser. No. 08/642,788 filed on May 3, 1996, which is now U.S. Pat. No. 5,870,798.

BACKGROUND OF THE INVENTION

1. Field of the Invention

The invention pertains to compact portable extractors for cleaning small carpeted areas, stairs, furniture, spots, upholstery, and spills on bare floors. More particularly, this invention pertains to a compact portable extractor having permanent, non-removable solution and recovery tanks, a fill port for filling the solution tank and a pour spout for facilitating emptying of the recovery tank and facilitating the overall operation of the extractor.

2. Related Prior Art

Most prior art extractors contain separate cleaning solution tanks or bottles, and/or separate recovery tanks that must be awkwardly and delicately removed from the extractor to be filled and discharged as required. In performing these operations with the prior art extractors, the user has to be extremely cautious not to spill the contents of these removable bottles and/or tanks upon the carpet or the extractor itself. With many of the prior art extractors it is even necessary to remove the entire powerhead in order to remove the recovery tank, or to remove a cleaning solution bottle or tank.

Many prior art extractors include a removable cleaning solution bottle having a special cap for connecting the bottle to a cleaning solution tube in the extractor. Connection of the cleaning solution tube to the cap is frequently very cumbersome, due to a relatively short length of the tubing extending from the extractor. This short length of tubing must be attached to the cap, while the cap is mounted on a filled cleaning solution bottle, by holding the bottle with one hand, while attempting to insert the fingers of the other hand between the bottle and the extractor to connect the short length of tubing extending from the extractor to the cap on the bottle.

SUMMARY OF THE INVENTION

The present invention overcomes the above cited disadvantages of the prior art extractors by providing a portable compact extractor having permanent solution and recovery tanks integrally formed in a single main tank portion, with a removable power head attached to and enclosing the top of the main tank portion. A fill port passes through the powerhead into the cleaning solution tank and a pour spout is formed in the recovery tank. With this construction, the cleaning solution tank may be filled with water and, if desired, detergent, by pouring the water and detergent into the fill port in the power head, and the recovery tank may be emptied as desired simply by tipping the unit and pouring the contents of the recovery tank out the pour spout and down the drain. All without ever having to remove any tanks, bottles or the power head from the unit, or disconnect and reconnect any tubing. A carry handle is located on the power head to facilitate transportation of the unit, facilitate removal of the power head from the main tank for cleaning the tanks when desired, and facilitate pouring the contents of the recovery tank out of the pour spout.

BRIEF DESCRIPTION OF THE DRAWINGS

The invention will now be described, by way of example, with reference to the attached drawings, of which:

FIG. 18 is a perspective view of the valve housing;

FIG. 19 is a top plan view of the valve member;

FIG. 20 is a perspective view of the trigger;

FIG. 21 is a side view of the valve cover;

FIG. 22 is a perspective view of the inside of the valve cover;

DETAILED DESCRIPTION OF THE PREFERRED EMBODIMENT(S)

Figure 1:
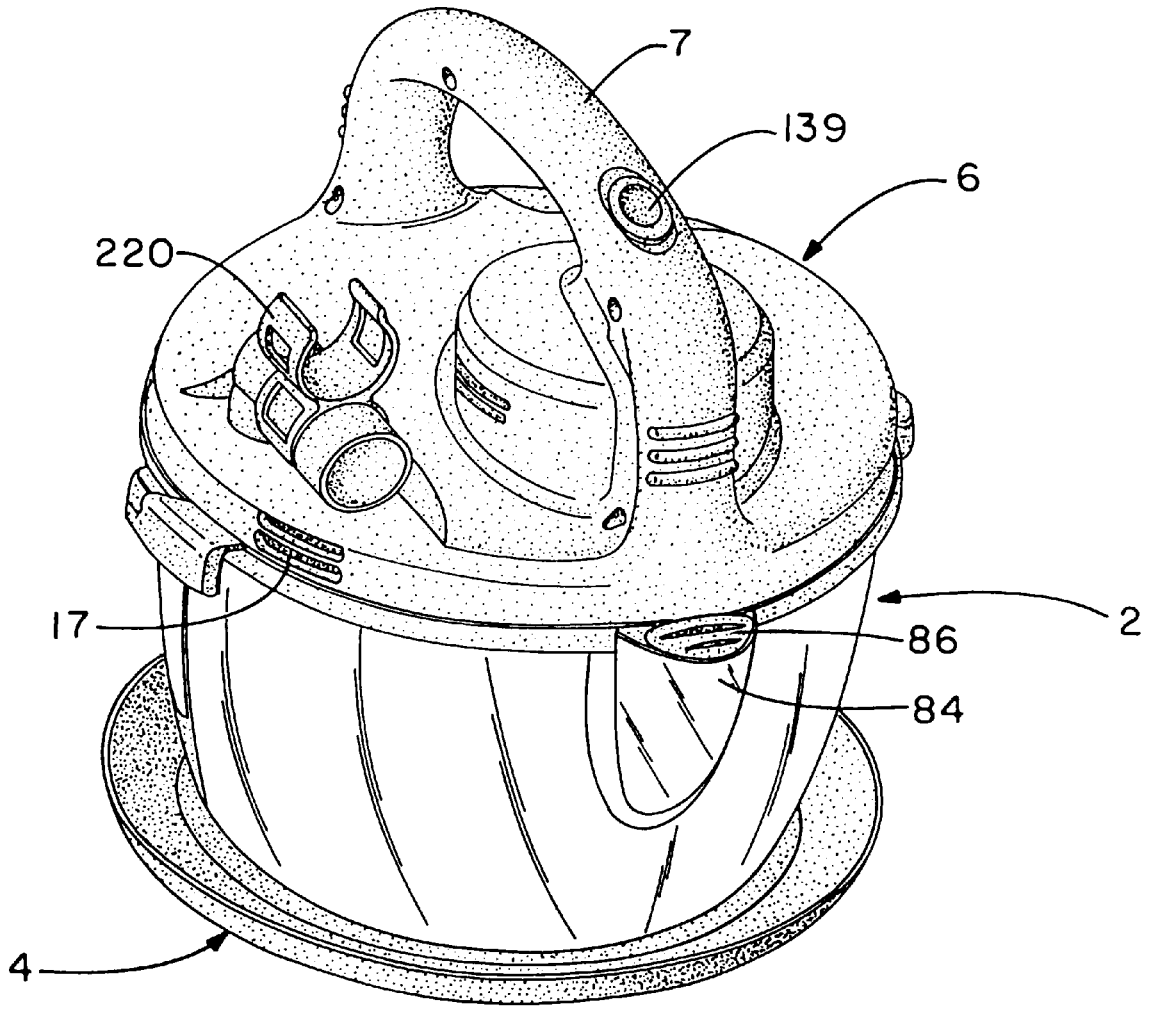
FIG. 1 is a perspective view of the portable extractor according to the invention.
Figure 2:
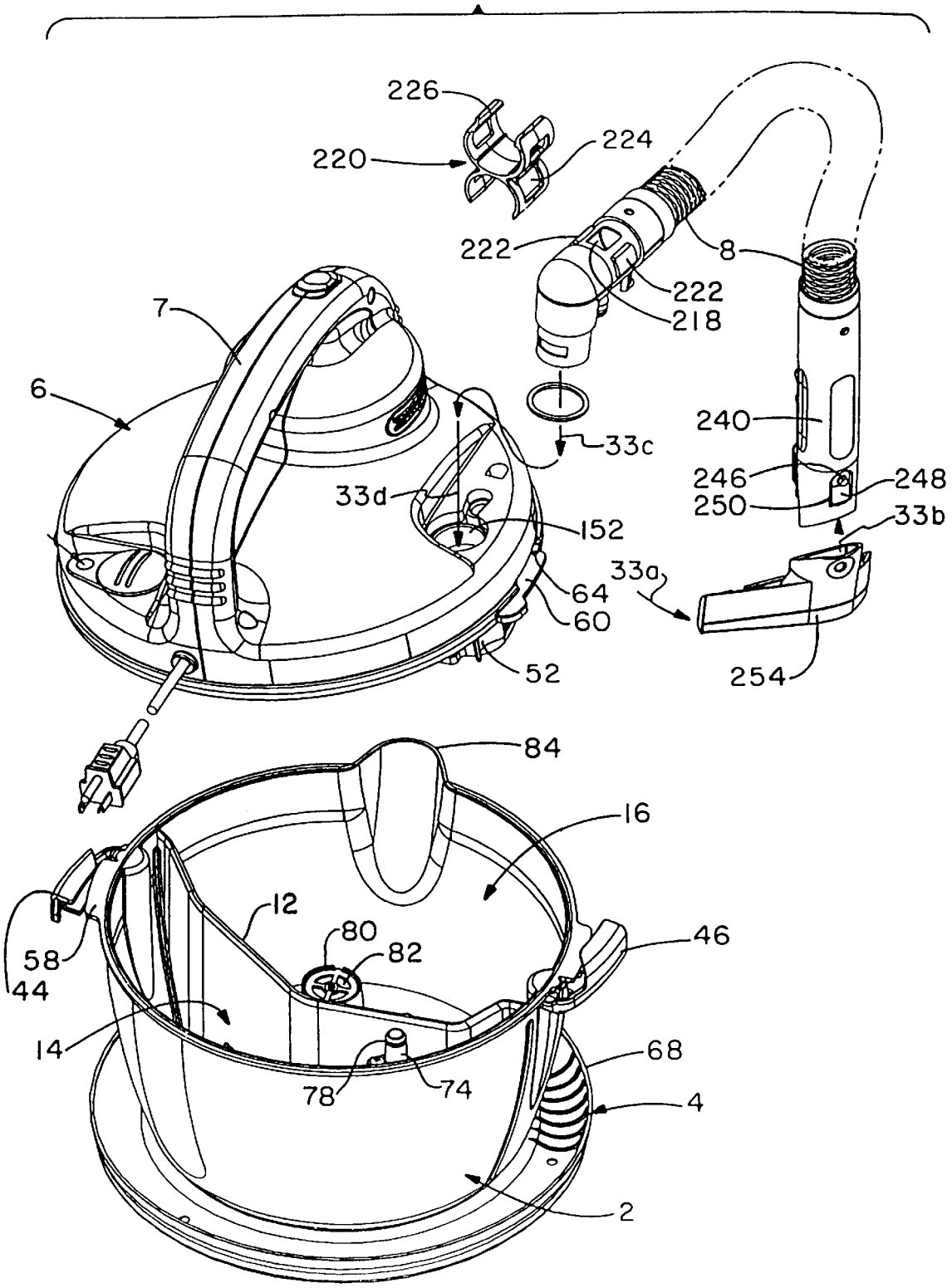
FIG. 2 is a partially exploded, perspective view of the extractor of FIG. 1, showing the power head removed from the tank assembly.
Figure 3:
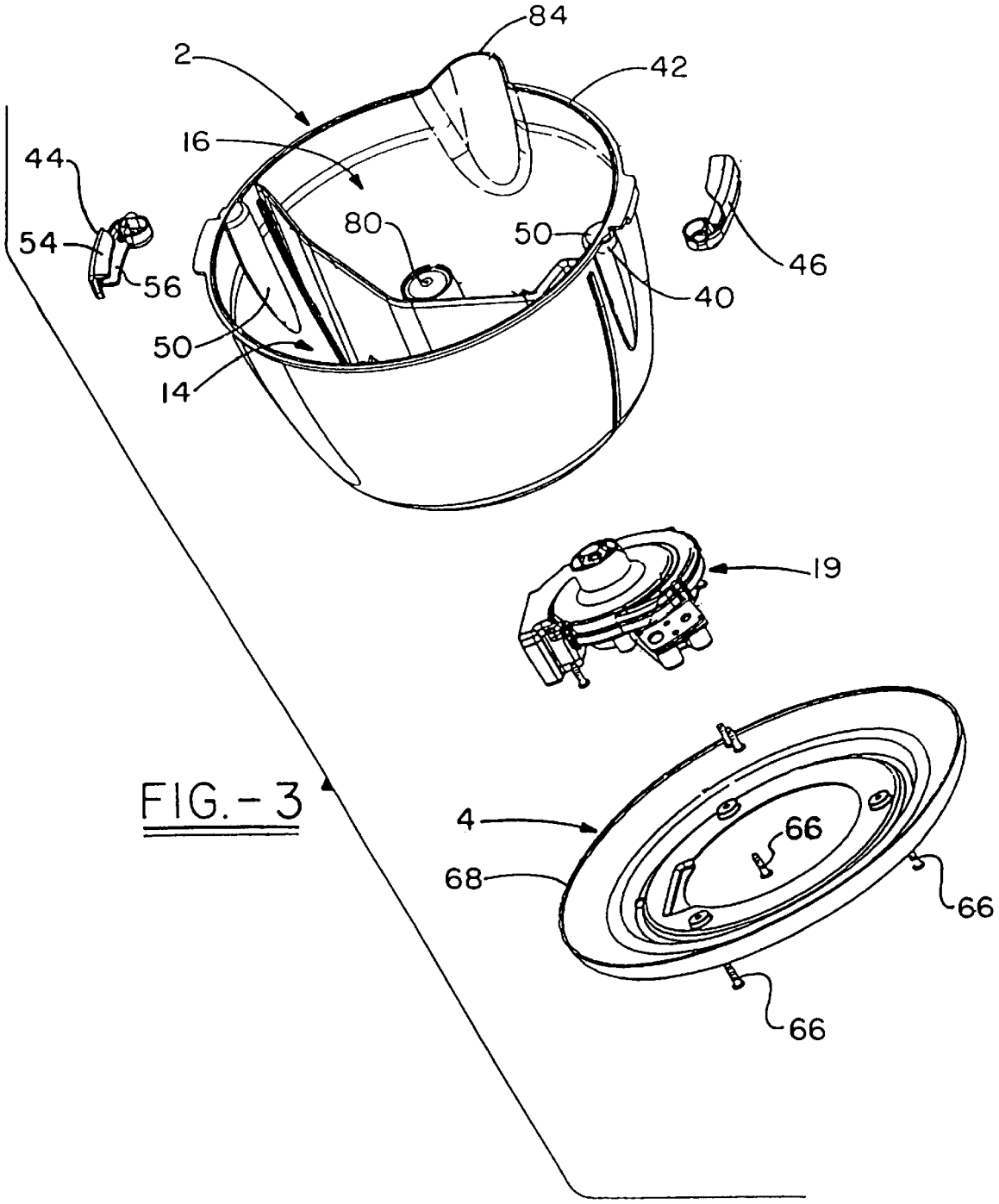
FIG. 3 is a partially exploded, perspective view of the tank assembly.
Figure 4:
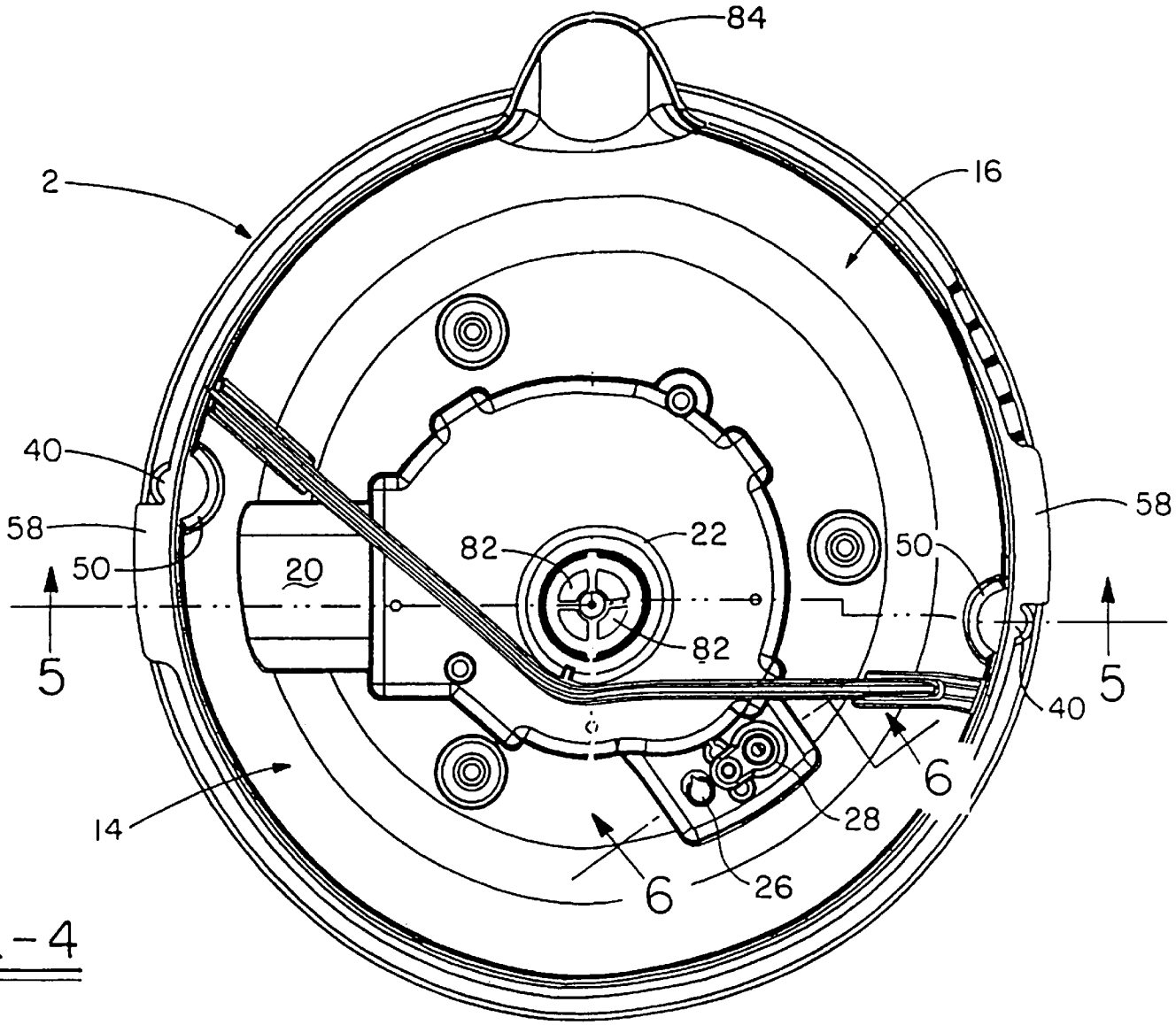
FIG. 4 is a plan view of the tank assembly.
Figure 5:
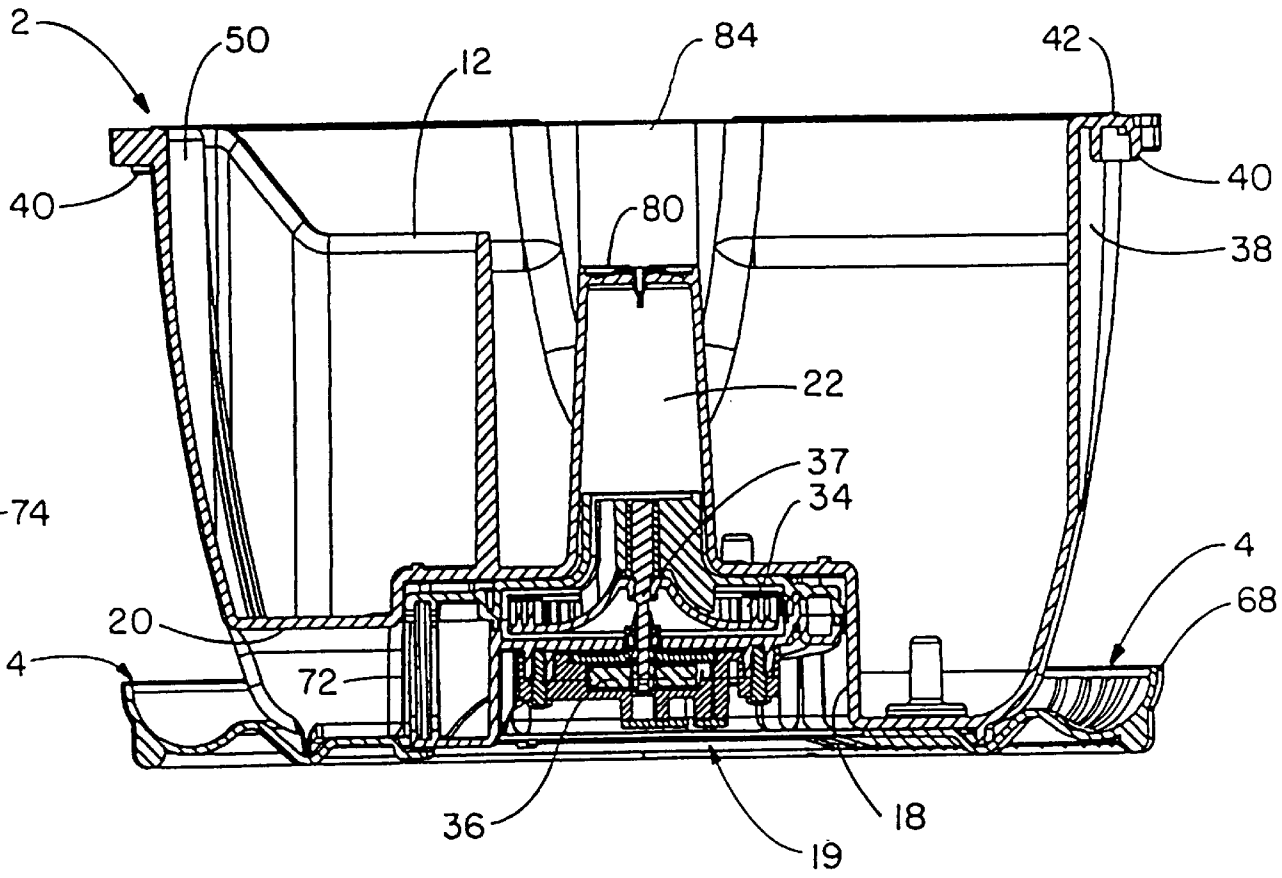
FIG. 5 is a cross section of the tank assembly, taken along line 5—5 in FIG. 4.
Figure 6:
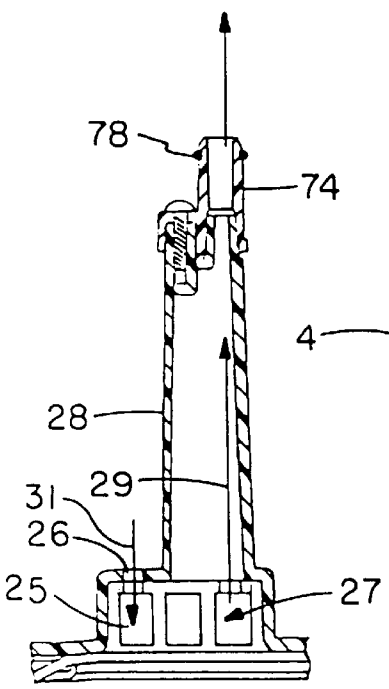
FIG. 6 is a cross section of the cleaning solution chimney, taken along line 6—6 of FIG. 4.

Referring now to FIGS. 1 and 2, the compact portable extractor according to the present invention generally comprises a main tank portion 2 having anti-tip base/hose storage tray 4 attached to the bottom thereof. A powerhead 6, with a carry handle 7, is removably attached to and encloses the top of the main tank 6. A first end of a suction hose 8 is permanently attached to the powerhead 6 and a second end of the suction hose 8 has a nozzle assembly 254 removably attached thereto. The main tank 2 is of a one-piece unitary molded construction and is preferably formed of polypropylene or other suitable plastic. A dividing wall 12 divides the main tank into a cleaning solution tank 14 and a recovery tank 16.

Figure 7:
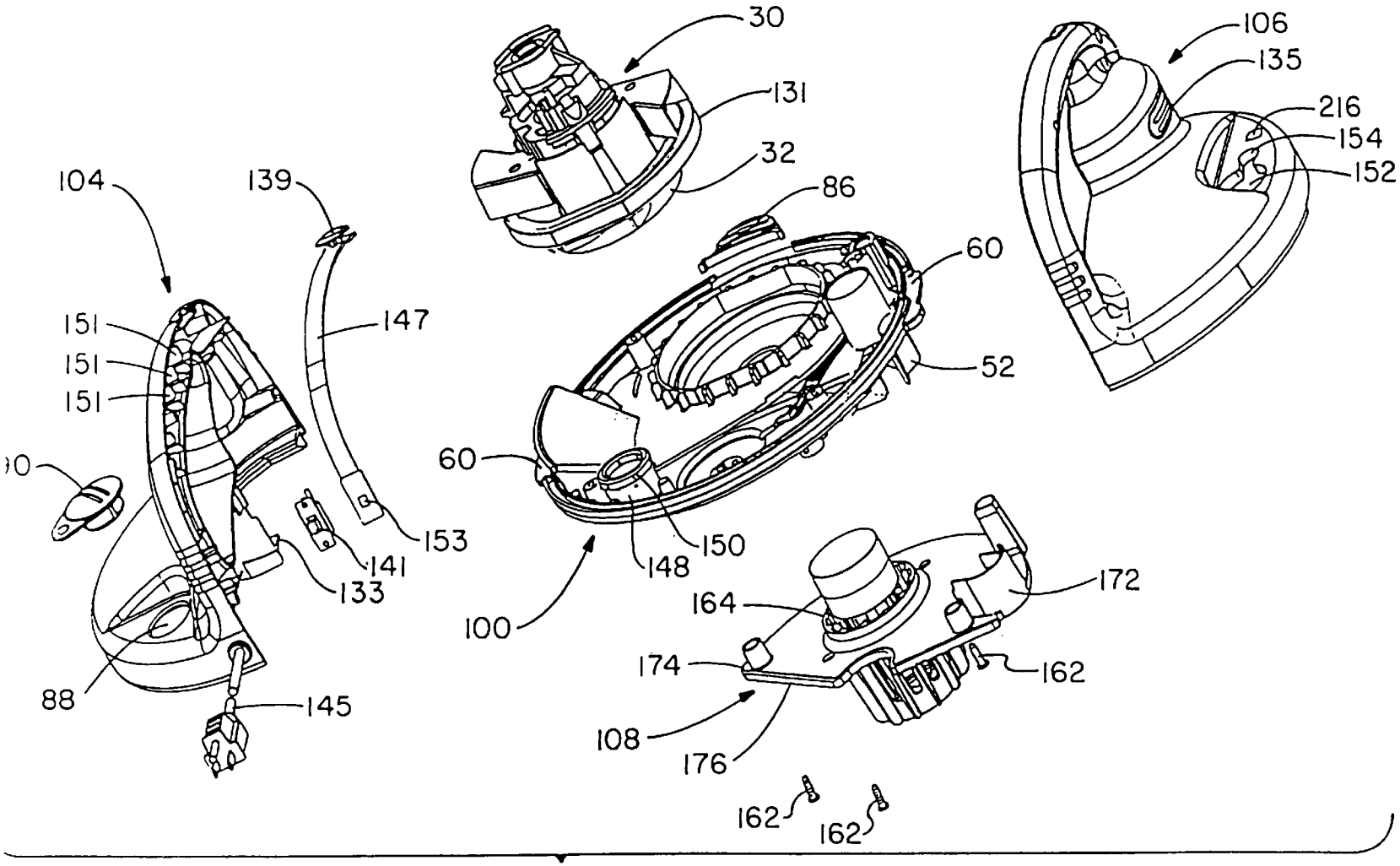
FIG. 7 is a partially exploded, perspective view of the power head assembly.

The powerhead 6 houses an electric motor 30 that drives a centrifugal blower 32 (see FIG. 7). The blower 32 exhausts air contained in the recovery tank 16 out vent 17 in the powerhead to the external atmosphere, thereby creating a partial vacuum in the recovery tank 16. The suction hose 8 communicates with the recovery tank 16, via the powerhead 6, such that the partial vacuum in the recovery tank sucks air through the vacuum hose for extracting spills and/or cleaning solution through the nozzle assembly 254, as illustrated by arrows 33*a* in FIG. 2. The partial vacuum in the recovery tank 16 also draws air from the external atmosphere through a turbine driven pump 19 for driving the pump and pumping cleaning solution from the cleaning solution tank 14 to a spray head mounted on the nozzle assembly 254, as described in more detail hereinafter.

Tank/Base Assembly

The tank and base assembly will be described with reference to FIGS. 2–6. A recess 18 (best seen in FIG. 5) is integrally molded into the bottom of the tank 2 for receiving the pneumatic turbine driven pump 19. An inlet duct 20 for feeding air to the turbine, and an exhaust chimney 22 for exhausting air from the turbine, are molded into the bottom of the tank 2. The turbine driven pump has a fluid inlet 25 that draws cleaning solution through inlet port 26 passing through the bottom of the cleaning solution tank (arrow 27), and a fluid outlet 27 that discharges the cleaning solution up cleaning solution chimney 28 (arrow 29). The cleaning solution chimney 28 is integrally molded in the tank 2, and delivers the cleaning solution to the powerhead 6 for delivery to a cleaning solution supply tube contained in the vacuum hose 8. A screen 72 is mounted in the inlet duct 20 to prevent dust and/or lint from being sucked into and clogging the turbine.

In order to rotatably align the powerhead 6 with the tank 2, semi-cylindrical recesses 38 are integrally molded into diametrically opposite sides of the tank 2. The semi-cylindrical recesses 38 form corresponding semi-cylindrical protrusions 50 in diametrically opposite inner surfaces of the tank 2. Protrusions 50 slidably engage corresponding semi-cylindrical aligning flanges 52 (best seen in FIG. 11) that extend downwardly from a lower surface of the powerhead 6, thereby aligning the powerhead 6 with the tank 2.

In order to secure powerhead 6 on the tank 2, latch mounting posts 40 are integrally molded with the underside of a radially extending lip 42 that extends outwardly from the top edge of the tank 2. Two identical latches 44 and 46 snap onto mounting posts 40 for pivotal motion about the mounting posts. When mounting the powerhead to the tank, the latches 44 and 46 are pivoted radially outwardly, as shown in FIG. 2, the a semi-cylindrical flanges 52 on the powerhead 6 are aligned with the semi-cylindrical protrusions 50 in the tank, the powerhead is lowered onto the top of the tank 2 and the latches 44 and 46 are pivoted radially inwardly. Flanges 58 and 60 extending radially outwardly from the tank 2 and the powerhead 6, respectively, are captured and clamped between flanges 54 and 56 on the latches 44 and 46, thereby clamping the powerhead 2 onto the top of the tank 2. The lip 42 on the top of the tank 2 is preferably clamped against a gasket in a groove 62 formed in a lower surface of the powerhead for creating a water-tight seal between the powerhead 6 and the tank 2. A nub on the lower surface of flanges 44 on the latches engages detents 64 in flanges 60 on the powerhead to maintain the latches in the closed position.

The anti-tip base 4 is attached to the bottom of the tank 2 by screws 66 or other suitable attachment means. The outer peripheral edge 68 of the anti-tip base 4 curves upwardly to facilitate sliding of the extractor along a carpeted or soft surface. The radius of curvature of the outer peripheral edge 68 of the anti-tip base 4 is substantially equal to or slightly smaller than the radius of the suction hose 8, such that the hose 8 can be wrapped around the tank 2 and snapped into the base 4. In this manner, the anti-tip base serves as a suction hose storage tray.

A quick connect/release cap 74 is mounted to the top of the cleaning solution supply chimney 28 by a screw or other suitable attachment means. The outer diameter of the quick connect/release cap 74 is sized to be closely received in a cylindrical fluid chimney receiving sleeve that extends downwardly from a lower surface of the powerhead 6 (See FIG. 11). An O-ring 78 is received in an annular groove in the outer surface of the quick connect/release cap 74 for creating a water-tight seal between the quick connect/release cap and the fluid chimney receiving sleeve. The fluid supply chimney 28 is molded into the cleaning solution tank portion 14 of the tank 2, so that if there is any leakage of cleaning solution from the top of the fluid supply chimney or from the seal between the quick connect/release cap and the fluid chimney receiving sleeve, the leaking cleaning solution will remain in the cleaning solution tank 14.

In order to prevent recovered solution from entering the exhaust chimney 22 and destroying the turbine 34, the turbine exhaust chimney 22 extends upwardly above the bottom of the recovery tank 16 a height sufficient to maintain the top of the chimney above the solution in the recovery tank at all times. Moreover, a resilient umbrella valve 80 (shown in FIG. 3, but not in FIG. 2) is attached to the top of the exhaust chimney 22, such that the umbrella valve completely covers the vent openings 82 in the top of the exhaust chimney 22. Upon activation of the blower 32, the difference in pressure created between the inside of the recovery tank 16 and the inside of the exhaust chimney 22 causes the edges of the resilient umbrella valve 80 to lift up, opening the vent openings 82 so that air can flow through the turbine 34 and out the vent openings to drive the turbine 34. The turbine drives the pump impeller 36 via drive shaft 37. When the blower 32 is shut off, the pressure in the recovery tank and in the exhaust. chimney become equalized, and the resilient umbrella valve 80 resiliently seals the vent openings 82 preventing any solution in the recovery tank 16 from sloshing and/or splashing into the exhaust chimney 22. In order to prevent the pump 19 from overheating in the event the blower is activated when no solution is in the cleaning solution tank 14, the size of the vent openings 82, the turbine inlet duct 20, and the exhaust chimney 22 are balanced with the power of the blower to limit the amount of air flowing through the turbine. The amount of air flowing through the turbine is limited to keep the rpm's of the impeller sufficiently low that the pump does not overheat when run dry.

A pour spout 84 is integrally molded into the recovery tank 2. A resilient spout cover 86 extends from the peripheral edge of the powerhead and over the open top of the pour spout 84. When the blower 32 is activated, the partial vacuum in the recovery tank 16 causes the resilient spout cover 86 to be sucked down over the open pour spout 84 to seal the spout and prevent any solution in the recovery tank 16 from sloshing and spilling out of the pour spout. When the blower is turned off, and the extractor is tilted forward, i.e. tilted toward the pour spout 84 such that the pour spout tips downwardly, the solution in the recovery tank is able to lift the resilient pour spout cover 86 and pour out of the pour spout 84. With this construction, a user is able to empty the recovery tank simply by lifting the extractor by the carry handle 7, holding the extractor over a sink or toilet, tipping the extractor forward, as one would tip a teapot, and pouring the contents of the recovery tank out the pour spout and into the sink or toilet.

A fill port 88, that communicates with the solution tank 14, is located in the top of the powerhead 6. A removable stopper 90 is received in the fill port in an interference fit for easy insertion and removal for filling the solution tank with detergent and water directly from a faucet, without removing the power head 6 from the tank 2. The spout cover 86 and the stopper 90 are formed of a suitable rubber or thermoplastic elastomer.

Due to the novel combination of the fill port 88 and the pour spout 84, a user may repeatedly fill the extractor with cleaning solution and empty the extractor of recovered dirty liquid without ever having to remove the powerhead, remove any tanks or bottles, or disconnect/reconnect any tubes etc., as is required with many of the prior art compact extractors. Thus, the present invention provides for a compact extractor that is very simple and easy to use compared to prior art extractors. Moreover, the powerhead may be easily removed for periodic cleaning of the solution tank and the recovery tank. The powerhead is removed simply by pivoting latches 44 and 46 outwardly, as shown in FIG. 2, and lifting the power head 6 from the tank 2 by carry handle 7.

Powerhead Assembly

The powerhead assembly 6 will now be described in detail with reference to FIGS. 7–11. The powerhead assembly 6 is comprised of five main components. Namely, a blower housing and motor mount assembly 100, an electric blower 30, 32, a powerhead housing, comprising left and right housing halves 104 and 106, respectively, and a condensor and automatic shut-off float cage assembly 108. Except for the electric blower, the powerhead and float cage assemblies are formed of a suitable plastic or polymer, preferably polypropylene. The electric blower is a conventional electric motor and centrifugal blower and does not in itself form a part of the invention. As such, the electric blower is not described in detail herein.

Figure 8:
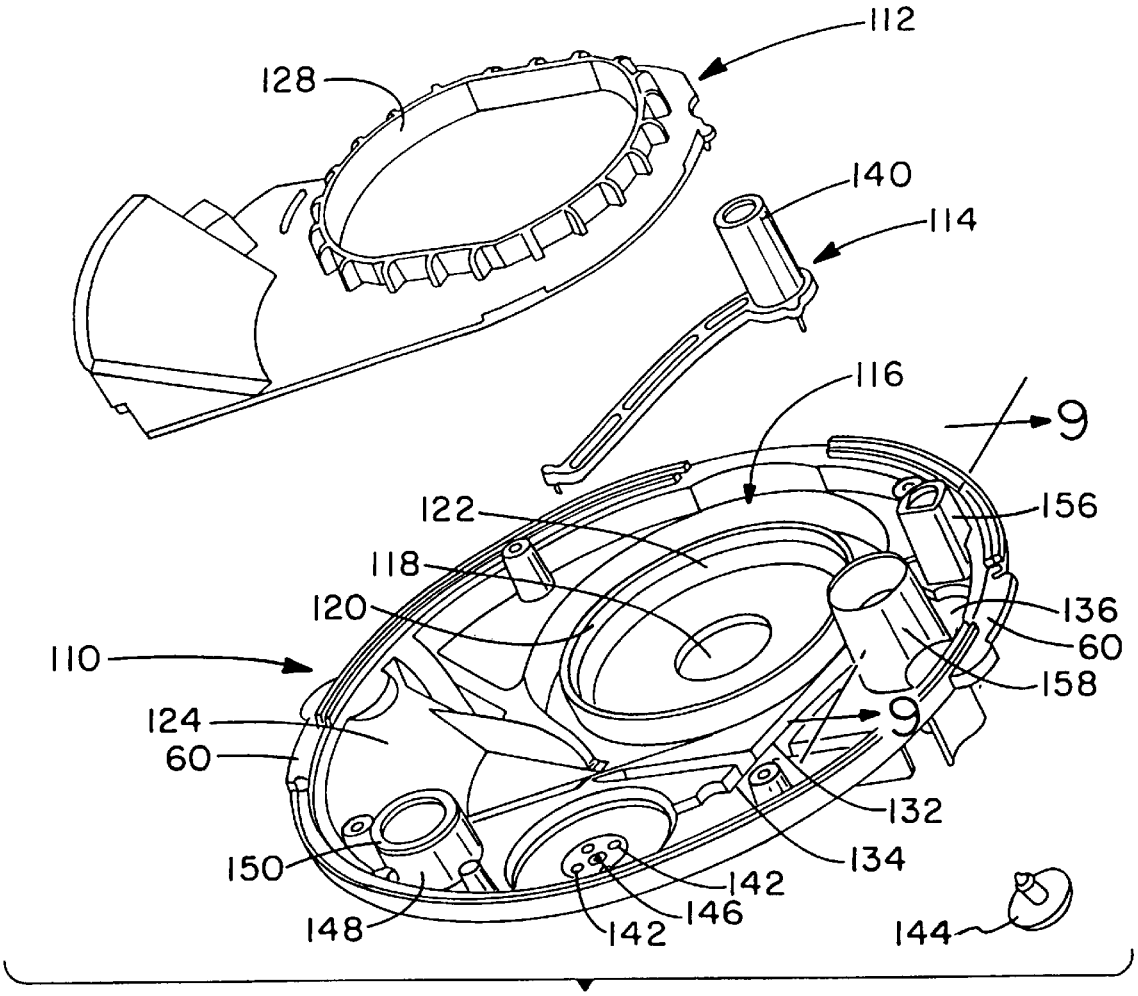
FIG. 8 is a partially exploded, perspective view of the main plate assembly of the power head.

As shown in FIG. 8, the blower housing assembly 100 is comprised of a main plate 110, an engine mounting plate 112, and a cleaning fluid duct cover 114. Recess 116 in main plate 110 defines a conventional volute diffuser blower housing and a central air inlet opening 118 provides fluid communication between the recovery tank 16 and the blower housing 32. Annular wall 120 is concentric to the air inlet opening 118 and defines a suction chamber 122 around the air inlet opening 118.

The engine mounting plate 112 encloses the volute diffuser 116 and defines an exhaust duct 124 for discharging air from the blower 32 out vent 17 in the left housing half 104. Upstanding wall 128 surrounds a motor mounting opening for mounting the electric motor 30 centrally over the air inlet opening 118, such that the centrifugal blower 32 is centrally located in the suction chamber 122 with the eye of the blower located immediately over the air inlet opening 118 for drawing air from the recovery tank through the inlet opening 118.

Figure 9:
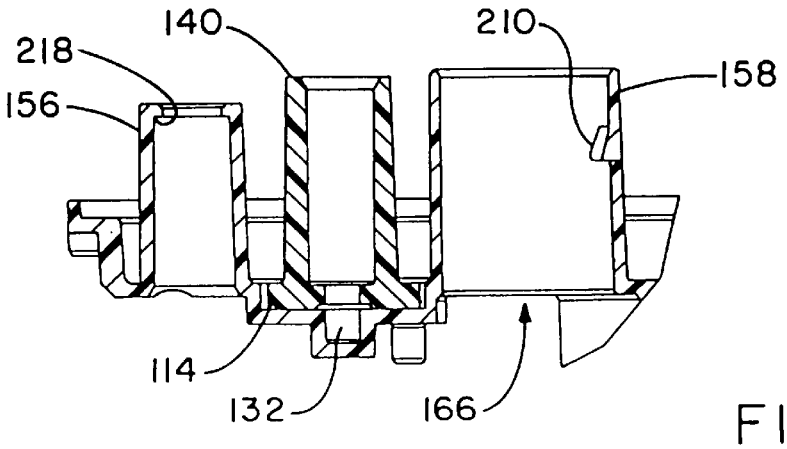
FIG. 9 is a cross section of a portion of the main plate, taken along line 9—9 in FIG. 8.

Referring to FIGS. 8 and 9, a cleaning fluid duct 132 is also molded into the blower housing main plate 110. The cleaning fluid duct cover 114 covers and encloses the cleaning fluid duct 132. The cleaning fluid duct cover 134 is cemented, welded or otherwise adhered to the blower housing main plate 110 to form a fluid-tight seal therewith. A first end 134 of the cleaning fluid duct 132 communicates with the cleaning solution receiving sleeve (see FIG. 11), for receiving cleaning solution from the turbine driven pump 19. A second end 136 of the cleaning solution duct 132 communicates with a cleaning solution outlet chimney 140 (see FIG. 9), which is integrally molded with and extends upwardly from the cleaning fluid duct cover 114, for delivering cleaning solution to the cleaning solution supply tube located in the suction hose 8, as described hereinafter in further detail.

Cooling vents 135 are located in the right and left housing halves to cool the electric motor with air from the external atmosphere. A pocket 137 is located inside each of the cooling vents 135 to catch any water that may enter the vents 137 and redirect the water back out the vents, thereby preventing any water that may enter the vents from short circuiting the electric motor 30. Grooves 139 and 144, preferably containing gaskets therein, are provided in one of the housing halves and a mating ridge is provided in the other of the housing halves to provide a liquid tight seal in the portions of the junctions between the housing halves that are exposed to the external atmosphere. Thus, water that may be spilled on the powerhead is substantially prevented from penetrating the powerhead.

A fill port duct 148 extends upwardly from the main plate 110, communicating the fill port 88 in the powerhead with the cleaning solution tank 14. A gasket 150 is preferably mounted to the top of the fill port duct 148 for creating a liquid tight seal between the fill port duct 148 and the left housing half 104 to prevent any cleaning solution from entering the powerhead 6. Upstanding post 156, extending upwardly from the main plate 110, is provided for receiving a snap connector, described in further detail hereinafter, extending downwardly from the suction hose assembly to permanently attach the suction hose to the powerhead. The first end of the suction hose 8 is permanently mounted to vacuum inlet duct 158 that extends upwardly from a vacuum inlet opening in the floor of the main plate 110.

Figure 10:
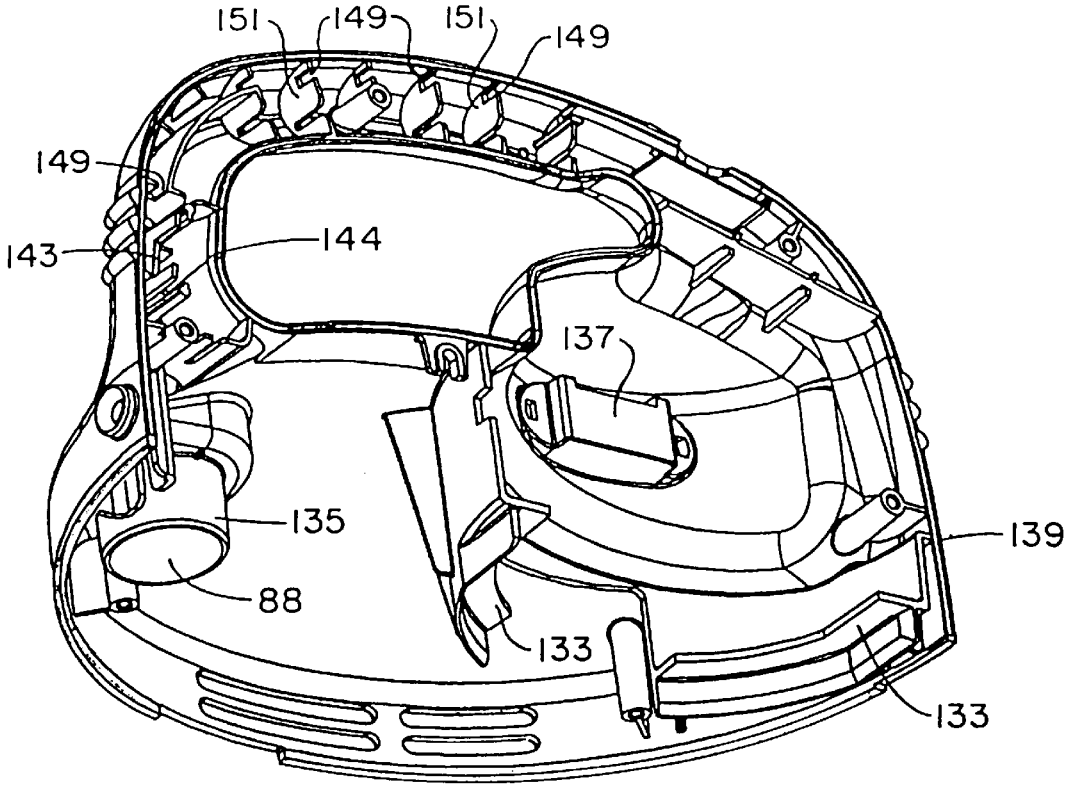
FIG. 10 is a perspective view of the power head left housing half.

Referring to FIGS. 7 and 10, in order to securely mount the motor 30 in the powerhead 6, a motor mounting flange 131 on the motor 30 is clamped between the top of the upstanding wall 128 and engine retaining flanges 133 molded on the inside of the left and right housing halves 104 and 106. The motor mounting flange 131 is preferably enclosed in foam rubber, such that the upstanding wall 128 and retaining flange 133 form a fluid tight seal with the mounting flange 131. The foam rubber also dampens unwanted motor vibrations. FIG. 10 is a perspective view of the inside of the left housing half 104. The left outer housing half 104 and the right outer housing half 106 are substantially mirror images of each other, except for the left outer housing half 104 contains the fill port 88 in a rear portion thereof and the right outer housing 106 half contains apertures 152 and 154 for respectively receiving the vacuum hose and the fluid supply hose therethrough, as described in further detail hereinafter. In order to drain any fluid that may accidentally get inside the powerhead, drain holes 142 are located in the floor of the main plate 110 that communicate with the recovery tank 16. An umbrella valve 144, which is identical to the umbrella valve 80, is mounted in aperture 146. When the blower is turned off, the umbrella valve resiliently covers and seals the drain holes 142 and prevents solution contained in the recovery tank 16 from passing up through the drain holes 142 and into the powerhead 6.

A blower actuator switch 139 is conveniently located on top of the carry handle 7, near the front of the handle for actuation by a thumb of a hand grasping the handle 7. With this construction, the blower can be easily turned on and off as desired while carrying the extractor by the carry handle 7 with one hand and holding the wand in the other hand. In order to facilitate assembly of the powerhead and reduce the cost of the extractor, the electric motor 30 is wired to a two-way electrical switch 141 that is located inside the powerhead at a location 143 adjacent to where the electrical power cord 145 enters the powerhead. The actuator switch is integrally formed with an elongate flexible strap 147 that is mounted in and guided by slots 149 defined in ribs 151 in the left and right housing halves 104 and 106. The electrical switch 141 is received in opening 153 in flexible strap 147, such that upon actuation of the actuator 139 by a user, the electrical switch is actuated by the flexible strap 147.

Figure 11:
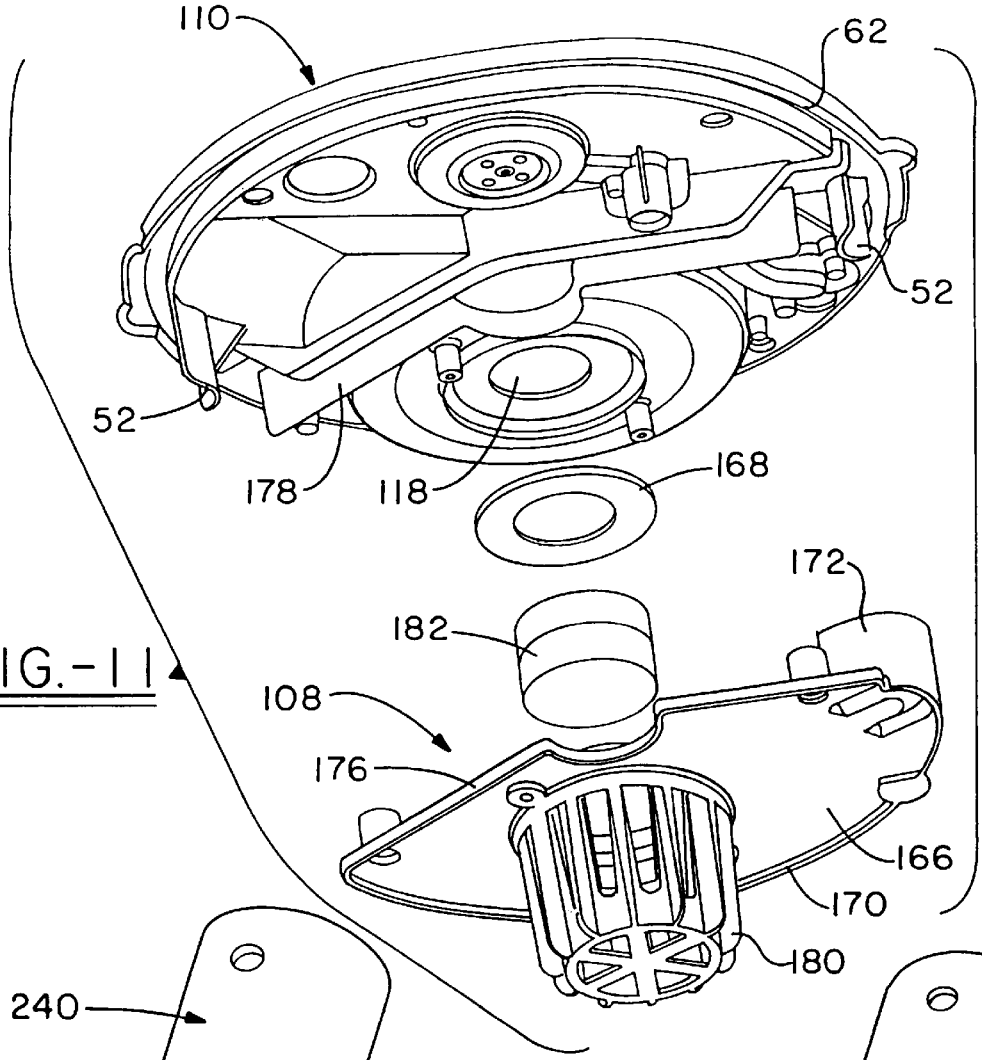
FIG. 11 is an exploded perspective view of the bottom of the main plate and float cage assembly.
Figure 16:
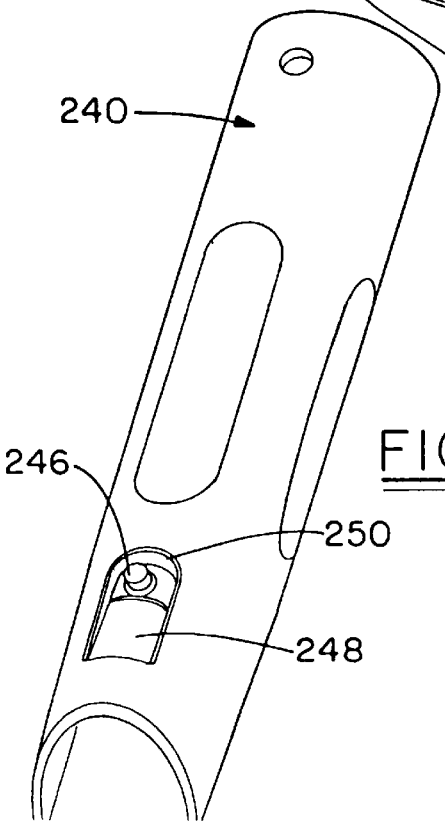
FIGS. 16 and 17 are a perspective view of the top and bottom, respectively, of the wand body.
Figure 17:
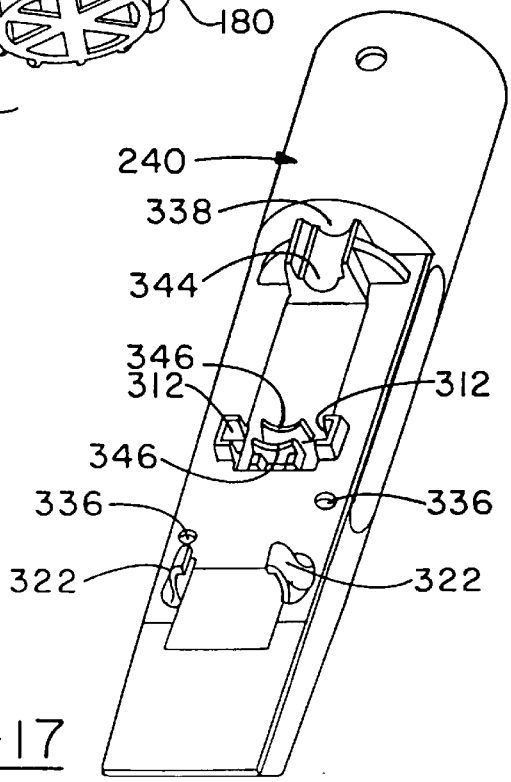

With reference now to FIGS. 7 and 11, the condenser and float cage assembly 108 is attached to the lower surface of the main plate 110 by screws 162. The assembly 108 includes a condenser plate 166, a float cage 180 and a float 182. A radial edge 170 of the condenser plate terminates a short distance from an inner surface of the outer wall of the recovery tank 16, such that a small gap is defined between the outer radial edge 170 of the condenser plate and the wall of the recovery tank. The liquid laden air entering the recovery tank through the suction inlet duct 158 enters at one corner of the condenser plate via elbow 172 and flows parallel to the condenser plate. As the liquid laden air exits the elbow 172 it quickly expands as it travels between the condenser plate 168 and the lower surface of the main plate 110, causing the liquid contained therein to condense on the condenser plate and the walls of the recovery tank. The recovered liquid drips off the radial edge 170 of the condenser plate, through the gap between the condenser plate and the wall of the recovery tank, and into the recovery tank 16. The top edge of the float cage 108 defines an annular wall 164 (see FIG. 7) that extends upwardly from condenser plate 166 and contacts the lower surface of the main plate 110 concentrically around the air inlet opening 118. A gasket 168 is clamped between the top edge 164 of the float cage and the lower surface of the main plate 110 to provide a water-tight and air-tight seal between the top edge of the annular wall 164 and the main plate 110, and thereby prevent any liquid or liquid laden air above condenser plate 166 from entering the air inlet 118 and the blower housing 100.

Recessed shoulder 174 (See FIG. 7) provided along an inner, substantially radial edge 176 of the condenser plate 166, receives a lower edge of a retaining wall 178 that extends downwardly from and is integrally molded with the main plate 110. As best seen in FIG. 11, the retaining wall 178 engages the recessed shoulder 174 in the inner edge of the condenser plate and prevents liquid laden air and liquid on the condenser plate from dripping off the inner edge of the condenser plate adjacent the turbine exhaust chimney, safeguarding against liquid on the condenser plate entering the turbine exhaust chimney.

The float cage 180 extends downwardly from the condenser plate and the float 182 is contained in the float cage. As the recovery tank fills with recovered liquid, the float 182 floats on the liquid and moves closer to the air inlet opening 118 in the main plate 110, until the suction created by the blower in the inlet opening 118 draws the float 182 up against the inlet opening. When the float 182 is drawn up against the inlet opening, the float seals the inlet opening, preventing the blower from suctioning liquid through the inlet opening 118 and into the blower housing. This condition is readily apparent due to a noticeably increased pitch of the blower noise. The gasket 166 between annual wall 164 and the main plate 110 preferably extends radially inwardly from the annular wall 164 a distance sufficient that when the float is suctioned up against the inlet opening 118, the gasket forms an airtight seal between the float 182 and the main plate 110. In order to prevent the blower housing from overheating when the float seals the inlet opening 118 and the blower remains on, a bleed hole extends through the floor of the suction chamber. The bleed hole is located at a point in the suction chamber where the pressure in the suction chamber is just sufficient to draw just enough air through the bleed hole to prevent overheating. If too much air passes through the bleed hole, liquid may be sucked through the bleed hole into the powerhead, or a user may not be able to audibly identify when the float seals the inlet opening.

Suction Hose and Wand Assembly

Figure 12:
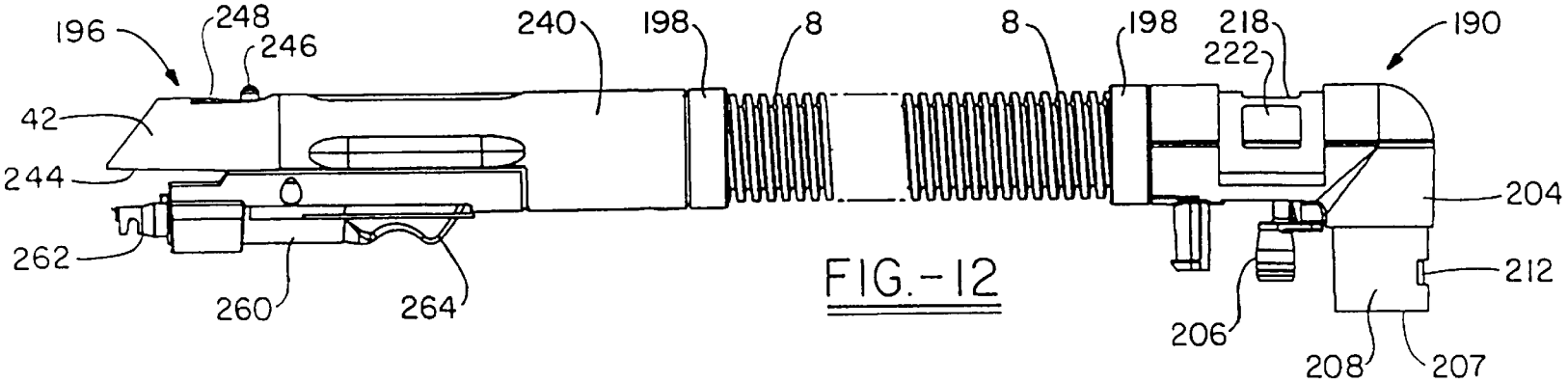
FIGS. 12–14 are a side view, bottom view and cross section, taken along line 14—14 in FIG. 13, respectively, of the hose assembly.
Figure 13:
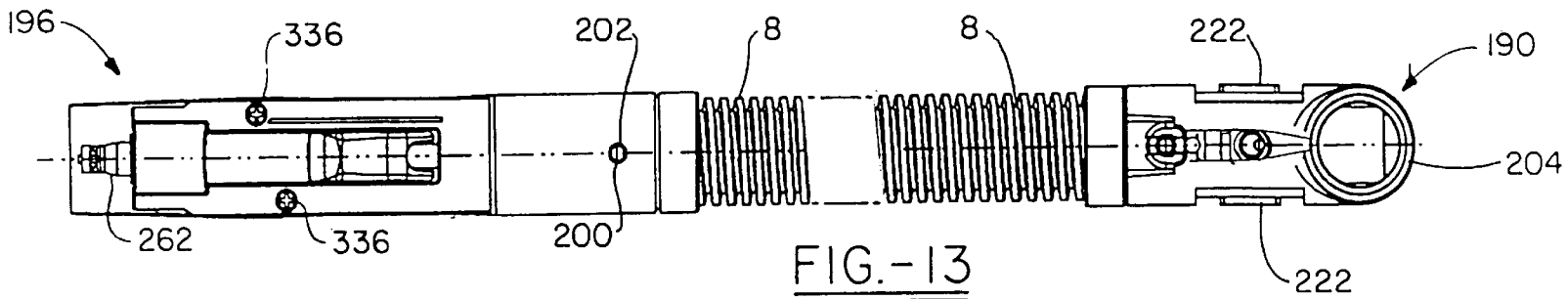
Figure 14:
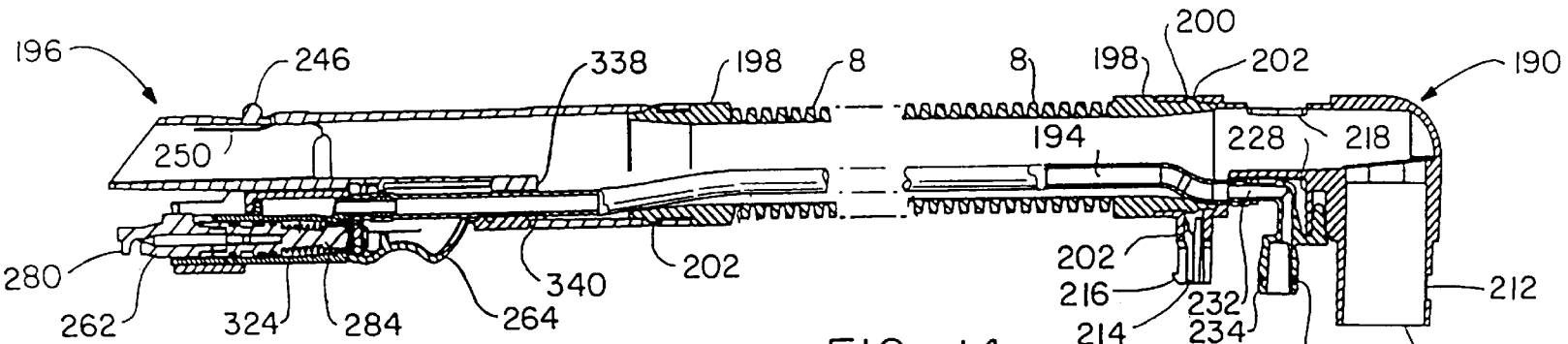
Figure 23:
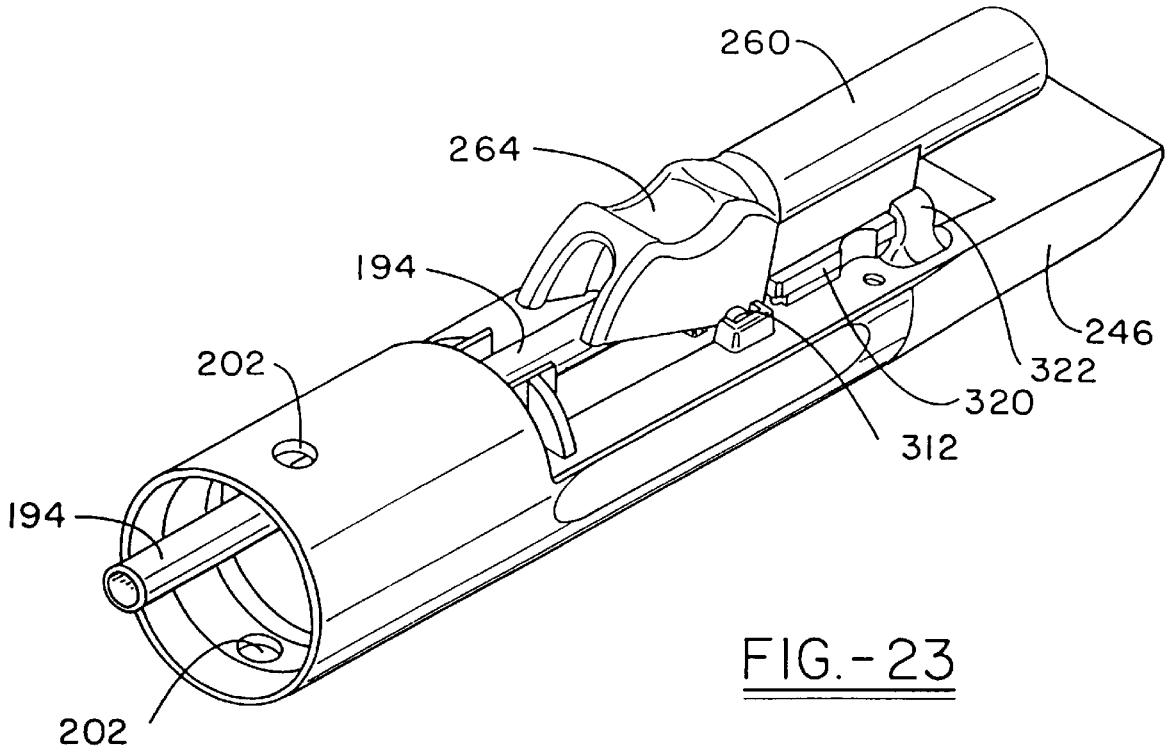
FIG. 23 is a perspective view of the valve assembly, without the valve cover.

The suction hose and wand assembly will hereinafter be described in further detail with reference to FIGS. 12–22. Referring now to FIGS. 12–14 (also see FIG. 2), the suction hose assembly is comprised of an elbow assembly 190 for connecting the flexible suction hose 8 and the cleaning solution tube 194, which is located inside suction hose 8, to the powerhead 6. A hand held suction and spray wand assembly 196 is attached to the free end of the suction hose 8 and solution tube 194. Tabs 200 on the outer periphery of collars 198, integrally formed on opposite ends of the suction hose 8, engage corresponding openings 202 in the end of the wand assembly 196 and the elbow assembly 190 to permanently mount the wand assembly and the elbow assembly to the suction hose 8.

The elbow assembly 190 is comprised of a suction elbow 204 for connecting the suction hose to the power head 6 and a smaller cleaning solution elbow 206 for connecting the cleaning solution tube 194 to the power head. The inner end 207 of the suction elbow 204 extends through aperture 152 in the right housing half 106, and reduced diameter portion 208 of inner end 207 extends into the suction inlet duct 158 on the main plate 110 of the power head. A shoulder 210 on the inner surface of the suction inlet duct 158 (see FIG. 9) engages a corresponding recess 212 formed in the outer peripheral surface of the reduced diameter portion 208 of the suction elbow 204 to permanently retain the suction elbow 204, and thereby the suction hose, to the power head. A mounting post 214 extends downwardly from a forward portion of the suction elbow 204. The mounting post 214 extends through opening 216 in the power head and into post 156 extending upwardly from the main plate 110. The end of the mounting post 214 is bifurcated forming two resilient retaining clips on the end of the mounting post. Each retaining clip has a chamfered shoulder 216 that snaps behind the shoulder 218 in the mounting post 156 (see FIG. 9) to permanently retain the mounting post to the power head 6. Thus, the suction elbow 204 is permanently attached to the main plate 110 of the power head 6 in two places, namely in the suction inlet duct 158 and in the post 156 in a stationary position.

A clean out opening 218, best seen in FIG. 2, passes through the wall of the suction elbow 204 for removing any foreign matter caught on the cleaning solution tube 194 or the recess 228 in the suction elbow 204 and clogging the suction elbow. A clip on clean out cover 220 (See FIG. 2) clips over shoulders 222 on either side of the clean out opening 218. The clip on clean out cover 220 is a resilient C-shaped member that resiliently expands to pass over the shoulders 222, until the shoulder 222 are received in openings 224 in either side of the clean out cover 220. A similar C-shaped resilient wand mounting clip 226 is integrally molded with the clip on clean out cover 220. A cylindrical portion of the wand 196 is resiliently retained upon the suction elbow 204 by the wand clip 226 for storage.

The cleaning solution elbow 206 is received in a recess 228 in the suction elbow 206 and is retained in place by a pin, integrally molded with the solution elbow 206, that is received in a corresponding opening in the suction elbow 204 in an interference fit. A first end of the solution elbow 206 defines a male flexible tubing nipple 232 for forming a liquid tight connection with the cleaning solution tube 194. The tubing 194 passes through an opening in the recess 228, immediately opposite the nipple 232. The second end of the solution elbow 206 defines a nipple 234 that is received in the cleaning solution outlet chimney 140 for receiving cleaning solution from the pump. An O-ring 236 is located in a groove in the outer peripheral surface of the nipple 234 for creating a liquid tight seal between the nipple 234 and the cleaning solution outlet chimney 140.

Figure 15:
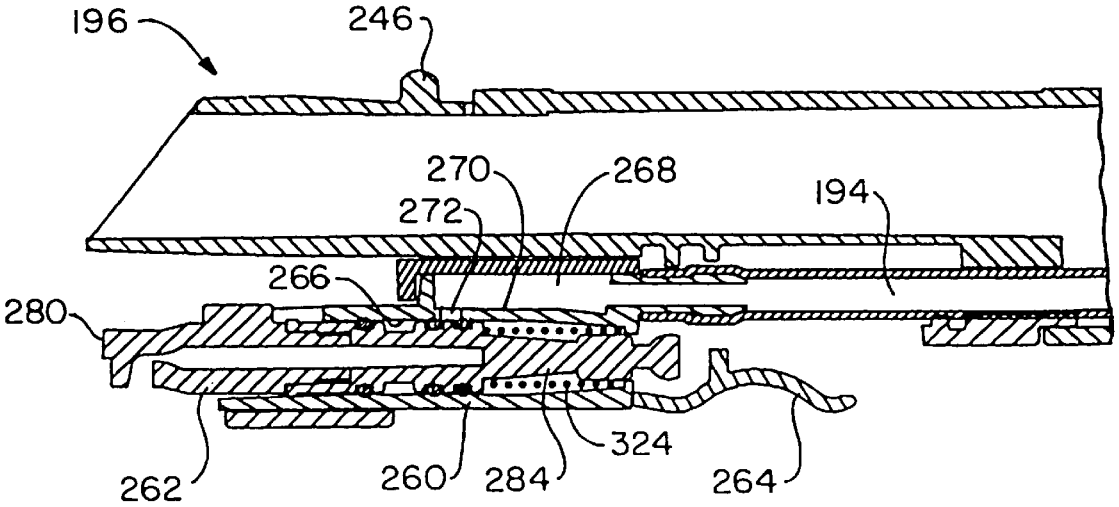
FIG. 15 is an enlarged cross sectional view of the spray valve assembly.

Referring to FIGS. 14 and 15, the wand assembly 196 comprises a rigid, substantially cylindrical wand assembly approximately 6 inches long that is permanently attached to the end of the suction hose 8. The wand assembly includes a tubular wand body 240. The forward portion 242 of the wand body is semi-circular in cross section, providing a semi-circular recess 244 for housing the trigger/valve assembly. A substantially semi-cylindrical valve cover 246 partially encloses the valve assembly, providing the wand/valve assembly a substantial cylindrical appearance. A retaining nub 248 is located adjacent the forward end of the wand body on a resilient tongue 250, for releasably retaining the suction nozzle 254 (see FIG. 2) on the forward end of the wand body. The tongue 250 is defined by a U-shaped slot 252 that passes through the outer peripheral wall of the wand body 240.

The trigger/valve assembly is comprised of three main components, a valve housing 260, a valve member 262, and a trigger 264. These three components are located on the valve body 240 by retaining hooks and flanges integrally molded into the wand body 240 and are retained in place by the valve cover 246. By using the wand cover 246 to retain the valve assembly in place on the valve body 240, the need for individual fasteners for each of the components of the trigger/valve assembly is eliminated. The overall number of parts in the assembly is thus reduced, thereby facilitating assembly and reducing assembly time.

The valve housing 260, shown in FIGS. 14, 15, 18 and 23, defines two chambers, a cylindrical valve chamber 266 and a cleaning solution supply chamber 268 separated by an intermediate wall 270 (see FIG. 15). A cleaning solution supply duct 272 passes through the intermediate wall 270, providing fluid communication between the two chambers.

The valve member 262, shown in FIGS. 14, 15 and 19, comprises a hollow tubular valve member that is slidingly received within the cylindrical valve chamber in the valve housing. A spray head 280 is located on a first end of the valve member and extends out of an open end 282 of the valve chamber. A reduced diameter portion 284 of the valve member extends through an opening 286 in an end wall 288 of the valve chamber. Three O-rings 290, 291, 292 are located in circumferential grooves in the outer periphery of a valve portion 294 of the valve member, and a cleaning solution inlet port 295 is located between two of the three O-rings nearest the spray head. For ease of manufacture, the valve member 262 is formed in two parts that are spin welded together.

The trigger 264, shown in FIG. 20, is a hollow member formed by two parallel walls 296, the lower edges of which are enclosed by a third wall that is normal to the two parallel walls. The third wall defines a concave arcuate actuation or trigger surface 300 that is curved to comfortably receive a "trigger" finger. A pair of opposed shoulders 302 extend inwardly toward each other from the two parallel walls to engage an annular recess 304 defined between knob 306 and enlarged portion 308 in the reduced diameter portion 284 of the valve member 262. A pair of opposed pivot pins 310 extend outwardly from the two parallel walls 296 of the trigger and are received in a corresponding pair of pivot pin mounting recesses defined by flanges 312 on the wand body.

The wand assembly 10 is assembled as follows. Mounting shoulders 320 extending from opposite sides of the valve housing 260 are slid under a pair of opposed retaining hooks 322 extending from the wand body 240; the solution supply tube 194 is connected to a conventional male nipple 348 that extends from the valve housing 260 and communicates with the solution supply chamber 268; a spiral spring 324 is mounted over the reduced diameter portion 284 of the valve member 262 and the valve member is inserted into the valve chamber 266, until the recess 304 on the reduced diameter portion extends through the opening 286 in the end wall 288 of the valve chamber and the spiral spring is partially compressed between the valve body and the end wall 288; the shoulders 302 in the trigger 264 are engaged with the recess 304 in the reduced diameter portion 284 of the valve member; and the trigger's pivot pins 310 are located in the pivot recesses defined by flanges 312 on the wand body.

In this configuration, when the trigger is in the released, unactuated position, the spring 324 biases the valve member 262 in a first direction, away from the trigger, to the unactuated closed position (illustrated in FIGS. 14 and 15) in which the two of the O-rings 291 and 292 remote from the spray head 280 are located on either side of the duct 272 passing through the intermediate wall, thereby sealing the duct 272. When the trigger 264 is depressed to the actuated position, the trigger pivots about the pivot pins 310 in pivot recesses 312, and the engagement of the shoulders 302 in the trigger with the recess 304 in the valve member causes the valve member 262 to move in a second direction, toward the trigger, to the actuated open position in which the fluid supply duct 277 is located between the two O-rings 290 and 291 nearest the spray head 280 in communication with the inlet port in the valve body. With the valve body in the actuated open position, cleaning solution may pass through the supply duct 272, the inlet port 295, the valve member 262 and out the spray head 280.

The valve cover 246, shown in FIGS. 21 and 22, contains two parallel elongate axially extending retaining shoulders 330 that, when the valve cover is mounted on the wand body 240, extend along either side of the valve housing 260 and engage the mounting shoulders 320 on the value housing, thereby retaining the valve housing 260 in place on the wand body 240. Tabs 332 on retaining shoulders 330 extend into the pivot recesses 312 and engage the pivot pins 310, thereby pivotally retaining the trigger 264 in place. Two screws extend through holes 334 in the valve cover 240 and are threaded into holes 336 in the valve body 240 to retain the valve cover in place on the wand body. With this construction, only two screws are required to secure the entire assembly. Although, it can be appreciated that any other suitable means, a snap fit, for example, may be used to mount the valve cover to the wand body.

The fluid supply tube 194, which is located within the suction hose 8, extends through an opening 338 between the semi-circular portion 242 of the wand body and the cylindrical portion of the wand body. The valve cover 246 has a tab 340, best seen in FIG. 22, that extends into this opening. Tab 340 has a semi-cylindrical recess 342 in its lower surface that cooperates with a semi-cylindrical recess 344 in the opening 338 in the wand body to define a cylindrical passageway through which tubing 194 passes. When the tab 340 is inserted into the opening 338 in the wand body, the cleaning solution tube 194 is lightly clamped between the tab and the wand body creating an airtight seal between the tube and the passageway formed by the valve cover and wand body. Arcuate ridges 346 press against tubing 194 to securely retain tubing 194 on nipple 348.

Figure 26:
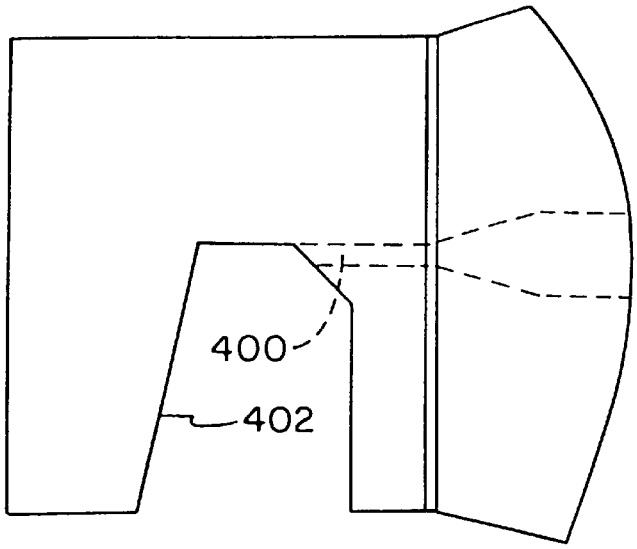
FIG.-26 PRIOR ART
FIG. 26 is a side view of a prior art spray head.

Referring to FIG. 26, many prior art spray heads contain a spray jet outlet 400 that emits a jet stream of liquid that strikes an angled deflection surface 402. The deflection surface deflects the stream of liquid and creates a fan-shaped spray pattern. The prior art deflection surfaces are planar and generate a relatively narrow spray pattern, as diagrammatically illustrated by spray pattern A in FIG. 27, that is suitable for prior art wands.

The wand according to the present invention is of a relatively compact construction. Due to the relatively compact size of the wand according to the present invention, when in use, the spray head 280 is located relatively close to the surface being sprayed, requiring a relatively wide spray pattern to spray a sufficiently wide swath of the surface being sprayed in a single pass.

Figure 24:
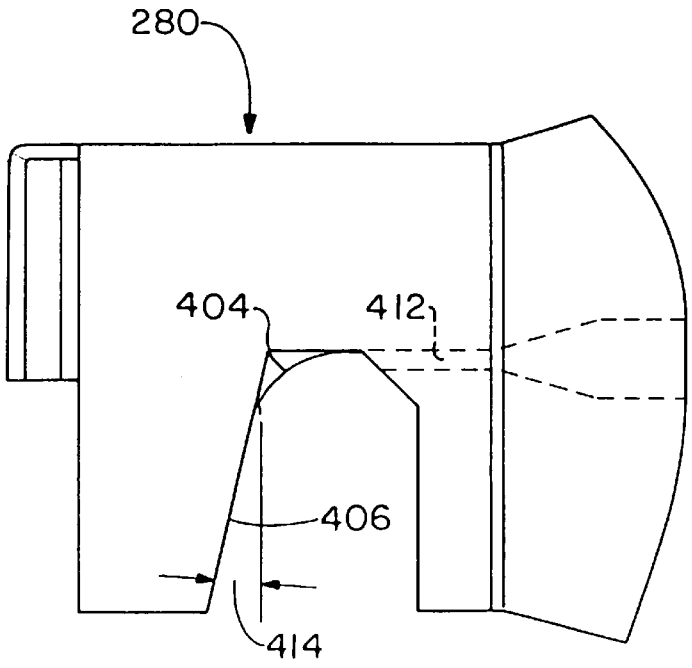
FIG. 24 is a side view of a spray head according to the present invention.
Figure 25:
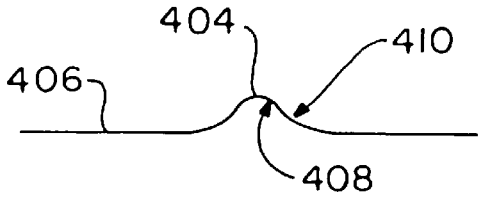
FIG. 25 is a diagrammic illustration of the contour of the deflection surface and fillet of the spray head according to the present invention.
Figure 27:
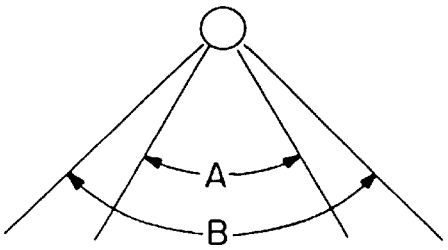
FIG. 27 is a diagrammatic comparison of the spray pattern produced by the spray head according to the present invention and the spray pattern produced by the prior art spray head.

Referring now to FIG. 24, in order to provide a relatively wide spray pattern, such as spray pattern B diagrammatically illustrated in FIG. 27, a generally cone-shaped rounded fillet 404 is provided on the deflection surface 406 of the spray head 280. As diagrammatically illustrated in FIG. 25, the fillet has a radius 408 that smoothly blends 410 into the otherwise planar deflection surface 406. The fillet deflects the jet stream emitted from the spray jet outlet 412 into a wider spray pattern than does a prior art planar deflection surface. To provide a substantially uniform spray pattern, the top of the fillet is rounded, i.e., radius 408, rather than sharp. When a sharp or pointed fillet is employed, the jet stream is split into two separate spray patterns.

The spray head according to the present invention has a spray jet outlet 412 having an inner diameter of approximately 0.04", a deflection surface 406 at a 12° deflection angle 414, and a fillet 404 having a radius 408 of approximately 0.078" that blends smoothly into the planar deflection surface 406. It can be appreciated, however, that the exact size, shape and radius of the fillet may be varied with the same results being achieved. Likewise, it can be appreciated that the size, shape and radius of the fillet depends upon the desired shape of the spray pattern. The size, shape and radius of the fillet is determined empirically through experimentation.

Although the present invention has been described in connection with a preferred embodiment, many variations and modifications will be become apparent to those skilled in the art upon reading the description. The scope of the present invention is intended to include such modifications and variations and not be limited by the specific example described herein.

Wherefore we claim:

1. A carpet and upholstery extractor comprising:

a cleaning liquid supply tank for providing a source of cleaning liquid, a pump in fluid communication with said supply tank for providing a source of pressurized cleaning liquid, a spray nozzle in fluid communication with said pump for receiving pressurized cleaning liquid from said pump and applying said cleaning liquid upon a surface to be cleaned;

a wet pickup nozzle, a recovery tank and a suction producing means fluid in communication with said pickup nozzle and said recovery tank for creating a reduced pressure in said recovery tank for drawing air and soiled cleaning liquid in through the pickup nozzle and into the recovery tank, where the recovered soiled cleaning liquid is separated from the air and collected in the recovery tank;

a pour spout having a discharge opening located in an upper portion of said recovery tank at a location spaced above a surface of the collected liquid when said recovery tank is filled to capacity; and wherein a pivotal spout cover extends across and immediately adjacent to said discharge opening, such that upon activation of said suction producing means the reduced pressure in said recovery tank draws the spout cover against said discharge opening and seals said discharge opening, and upon inclination of said extractor toward said pour spout, when said suction producing means is deactivated, the spout cover pivots under the pressure of the collected liquid such said collected liquid may be freely discharged through said pour spout.

2. An extractor according to claim 1, wherein said spout cover is formed of resilient material and resiliently yields under the pressure of the collected liquid upon inclination of the extractor for opening said pour spout and discharging the collected liquid.

3. An extractor according to claim 1, wherein said recovery tank has an open top and a removable lid encloses the top of said recovery tank.

4. An extractor according to claim 3, wherein said pour spout extends out from an upper peripheral edge of said recovery tank and has an open top for discharging the collected liquid.

5. An extractor according to claim 4, wherein said spout cover extends out from a peripheral edge of said lid and covers said open top of said pour spout.

6. An extractor according to claim 5, wherein said spout cover is formed of resilient material and resiliently yields under the pressure of the collected liquid upon inclination of the extractor for opening said pour spout and discharging the collected liquid.

7. A wet pickup vacuum cleaner comprising:

a wet pickup suction nozzle, a recovery tank and a motor fan assembly in fluid in communication with said suction nozzle and said recovery tank for drawing air and soiled cleaning liquid in through said suction nozzle and into said recovery tank, where the recovered soiled cleaning liquid is separated from the air and collected in said recovery tank;

an open topped pour spout located in an upper portion of said recovery tank; and wherein a pivotal spout cover extends across and immediately adjacent to the open top of said pour spout, such that upon activation of said motor fan assembly the reduced pressure in said recovery tank draws said spout cover against the open top of said pour spout and seals said pour spout, and upon inclination of said vacuum cleaner toward said pour spout, when said motor fan assembly is deactivated, said spout cover pivots under the pressure of the collected liquid such said collected liquid may be freely discharged through said pour spout.

8. A vacuum cleaner according to claim 7, wherein said spout cover is formed of resilient material and pivots by resiliently yielding under the pressure of the collected liquid upon inclination of said vacuum cleaner.

9. A vacuum cleaner according to claim 7, wherein said recovery tank has an open top and a removable lid encloses the top of said recovery tank.

10. A vacuum cleaner according to claim 9, wherein said pour spout is formed in an upper peripheral edge of said recovery tank.

11. A vacuum cleaner according to claim 10, wherein said spout cover extends radially out from a peripheral edge of said lid.

12. A vacuum cleaner according to claim 11, wherein said spout cover is formed of resilient material and resiliently yields under the force of the reduced pressure in the recovery tank to seal said pour spout when said motor fan assembly is activated, and yields under the pressure of the collected liquid upon inclination of said vacuum cleaner when said motor fan assembly is deactivated.

13. A carpet and upholstery extractor comprising:

a cleaning liquid supply tank for providing a source of cleaning liquid, a cleaning liquid applicator, and a cleaning liquid supply conduit fluidly communicating said supply tank with said applicator for applying cleaning liquid to a surface to be cleaned;

a wet pickup suction nozzle, a recovery tank, and a motor fan assembly in communication with said suction nozzle and said recovery tank for drawing air and soiled cleaning liquid in through said suction nozzle and into said recovery tank, where the recovered soiled cleaning liquid is separated from the air and collected in said recovery tank;

a pour spout having a discharge opening located in an upper portion of said recovery tank at a location spaced above a surface of the collected liquid when said recovery tank is filled to capacity; and wherein a pivotal spout cover extends across and immediately adjacent to said discharge opening, such that upon activation of said motor fan assembly the reduced pressure in said recovery tank draws said spout cover against said discharge opening and seals said discharge opening, and upon inclination of said extractor toward said pour spout when said motor fan assembly is deactivated said spout cover pivots under the pressure of the collected liquid such that said collected liquid may be freely discharged through said pour spout.

14. An extractor according to claim 13, wherein said spout cover is formed of resilient material and pivots by resiliently yielding under the pressure of the collected liquid upon inclination of said extractor.

15. An extractor according to claim 14, wherein said recovery tank has an open top, a removable lid encloses the top of said recovery tank, said pour spout is formed in an upper peripheral edge of said recovery tank, and said spout cover extends radially out from a peripheral edge of said lid.

* * * * *